US008567092B2

(12) United States Patent
Park

(10) Patent No.: US 8,567,092 B2
(45) Date of Patent: Oct. 29, 2013

(54) VENTILATION SOLE FOR SHOES

(75) Inventor: Chun-bae Park, Gimhae-si (KR)

(73) Assignee: Kyungdo Co., Ltd. (KR)

( * ) Notice: Subject to any disclaimer, the term of this patent is extended or adjusted under 35 U.S.C. 154(b) by 12 days.

(21) Appl. No.: 13/345,877

(22) Filed: Jan. 9, 2012

(65) Prior Publication Data

US 2012/0102788 A1 May 3, 2012

Related U.S. Application Data

(63) Continuation of application No. PCT/KR2010/003034, filed on May 13, 2010.

(30) Foreign Application Priority Data

Jul. 15, 2009 (KR) ..... 10-2009-0064599
Apr. 16, 2010 (KR) ..... 10-2010-0035203

(51) Int. Cl.
*A43B 7/06* (2006.01)

(52) U.S. Cl.
USPC ..... 36/3 R; 36/3 B

(58) Field of Classification Search
USPC ..... 36/3 R, 3 A, 3 B, 29
See application file for complete search history.

(56) References Cited

U.S. PATENT DOCUMENTS 4,771,555 A * 9/1988 Ohashi ..... 36/3 R
4,813,160 A * 3/1989 Kuznetz ..... 36/3 R
6,742,288 B2 * 6/2004 Choi ..... 36/132
7,726,041 B2 * 6/2010 Woo et al. ..... 36/3 B
2004/0088882 A1 * 5/2004 Buttigieg ..... 36/3 B
2004/0211085 A1 * 10/2004 Passke et al. ..... 36/3 B
2007/0209233 A1 9/2007 Kim et al.
2008/0163517 A1 * 7/2008 Chen ..... 36/3 B

FOREIGN PATENT DOCUMENTS

JP 09299103 A 11/1997
KR 2019960016107 U 6/1996
KR 100721036 B1 5/2007

OTHER PUBLICATIONS

PCT International Search Report (PCT/KR2010/003034), Jan. 18, 2011.

* cited by examiner

*Primary Examiner* — Marie Patterson
(74) *Attorney, Agent, or Firm* — Park & Associates IP Law, P.C.

(57) ABSTRACT

A ventilation sole for footwear, in which an air inlet-outlet is formed in a side of the ventilation sole, vents are formed in an upper portion of the ventilation sole, the vents communicating with the air inlet-outlet, and a device for opening and closing an air inlet-outlet, which is coupled with the air inlet-outlet, supplies ambient air into the footwear. The device for opening and closing an air inlet-outlet is adapted to be opened or closed by a locking or unlocking action when turned, and is disposed in the air inlet-outlet such that it is exposed to the outside. Since the device is opened and closed by the turning action of the button cap, the user can conveniently open or close the air inlet-outlet.

6 Claims, 3 Drawing Sheets

( a )

( b )

( a )

( b )

VENTILATION SOLE FOR SHOES

REFERENCE TO RELATED APPLICATIONS

This is a continuation of pending International Patent Application PCR/KR2010/003034 filed on May 13, 2010, which designates the United States and claims priority of Korean Patent Application No. 10-2009-0064599 filed on Jul. 15, 2009, and Korean Patent Application No. 10-2010-0035203 filed on Apr. 16, 2010, the entire contents of which are incorporated herein by reference.

FIELD OF THE INVENTION

The present invention relates, in general, to a ventilation sole for footwear and, more particularly, to a ventilation sole for footwear, in which an air inlet and an air outlet, which are provided inside the footwear sole such that ambient air can be introduced and discharged, can be opened and closed by a user.

BACKGROUND OF THE INVENTION

Footwear is typically fabricated using leather or synthetic resin, which has poor ventilation. Therefore, when footwear is worn for a long time, the inside of the footwear becomes hot, since the inside air is not efficiently ventilated with ambient air. At that time, sweat makes the inside of the footwear humid, thereby causing some problems. For example, mold or the like may grow, the feet may give out an odor, or the user may have athlete's foot.

In order to solve the foregoing problems, a ventilation sole for footwear, which enables air to circulate through the inside and outside of footwear, was proposed.

FIG. 1 is a perspective view of a ventilation sole for footwear of the related art.

As shown in FIG. 1, a ventilation sole 10 for footwear of the related art includes air inlet-outlets 11 formed in sides of the sole, vents 12 formed in the upper surface of the sole, and air passages (not shown), which connect the air inlet-outlets 11 to the vents 12, such that ambient air is supplied into the footwear.

In the ventilation sole for footwear of the related art, however, the air inlet-outlets are always opened irrespective of the intention of a user, such that rain water permeates into the footwear when it rains, or dust is introduced and clogs the vents in dusty areas, thereby causing an inconvenience when used.

SUMMARY OF THE INVENTION

Accordingly, the present invention has been made keeping in mind the above problems occurring in the related art, and is intended to provide a ventilation sole for footwear, in which a device for opening and closing an air inlet-outlet is provided in the ventilation sole, such that a user can open or close the air inlet-outlet with a simple manipulation.

In an aspect, the present invention provides a ventilation sole for footwear, in which an air inlet-outlet is formed in a side of the ventilation sole, vents are formed in an upper portion of the ventilation sole, the vents communicating with the air inlet-outlet, and a device for opening and closing an air inlet-outlet, which is coupled with the air inlet-outlet, supplies ambient air into the footwear. The device for opening and closing an air inlet-outlet is adapted to be opened or closed by a locking or unlocking action when turned, and is disposed in the air inlet-outlet such that it is exposed to the outside. The device for opening and closing an air inlet-outlet generally includes a main cap, the front and rear portions of the main cap having an open structure to form a flow passage; a button cap inserted into the main cap, the button cap being coupled such that it is exposed through the air inlet-outlet, and being locked or unlocked; and an elastic stopper inserted into the main cap, in which the elastic stopper elastically advances and retreats in response to a locking or unlocking action of the button cap, thereby opening or closing the flow passage formed in the main cap.

In addition, it is preferred that the device for opening and closing an air inlet-outlet include a main cap, front and rear portions of the main cap having an open structure to form a flow passage; a button cap inserted into and coupled with the main cap, a pressure section being formed in a central portion of the button cap, ambient air inlet-outlet holes being formed around the pressure section, and a head being exposed to the air inlet-outlet; an elastic stopper inserted into the main cap, the elastic stopper having an elastic section butted against the pressure section of the button cap, air inlet-outlet passages, a spring, one end of the spring being supported on the other side of the elastic stopper, such that the elastic stopper elastically advances or retreats in response to a locking or unlocking action of the button cap; an elastic stopper holder disposed inside the main cap, the elastic stopper holder containing the elastic stopper therein, and being sealably coupled with the elastic stopper via a sealing member, such that a seal between the elastic stopper and the elastic stopper holder is released when the button cap is locked; and a spring cover inserted into the main cap, the spring cover being closely coupled with the elastic stopper holder, supporting the other end of the spring of the elastic stopper, and having an inner air inlet-outlet in a central portion thereof.

Furthermore, it is preferred that the button cap have a grasping recess in the head of the button cap in a portion thereof that is exposed to the air inlet-outlet, the grasping recess facilitating a rotation of the button cap. It is more preferred that the button cap have a plurality of the ambient air inlet-outlet holes on both sides of the grasping recess.

In addition, it is preferred that the elastic stopper include the elastic section in contact with the pressure section of the button cap; the sealing member coupled with an outer circumference of the elastic section; a support plate formed on the other side of the elastic section, a diameter of the support plate being greater than that of the elastic section, an air inlet-outlet passage being formed in a circumference of the support plate, and the support plate being in contact with an inner circumference of the elastic stopper holder; and a flow passage-forming plate formed on the other side of the support plate, a diameter of the flow passage-forming plate being smaller than that of the support plate. The flow passage-forming plate has an air inlet-outlet passage formed in a circumference thereof and a receiving portion, which contains the spring therein, formed in a central portion thereof.

Furthermore, it is preferred that the elastic stopper holder be cylindrically shaped, the diameter of a portion of the stopper holder that is adjacent to the elastic section being smaller than that of the other portions of the stopper holder, such that of the stopper holder is closely coupled with the sealing member, which is coupled with the elastic section.

According to the present invention as described above, since the device for opening and closing an air inlet-outlet is disposed in the air inlet-outlet of the ventilation sole such that it is opened and closed by the turning action of the button cap, the user can conveniently open or close the air inlet-outlet.

MAJOR REFERENCE NUMERALS OF THE DRAWINGS

Figure 1:
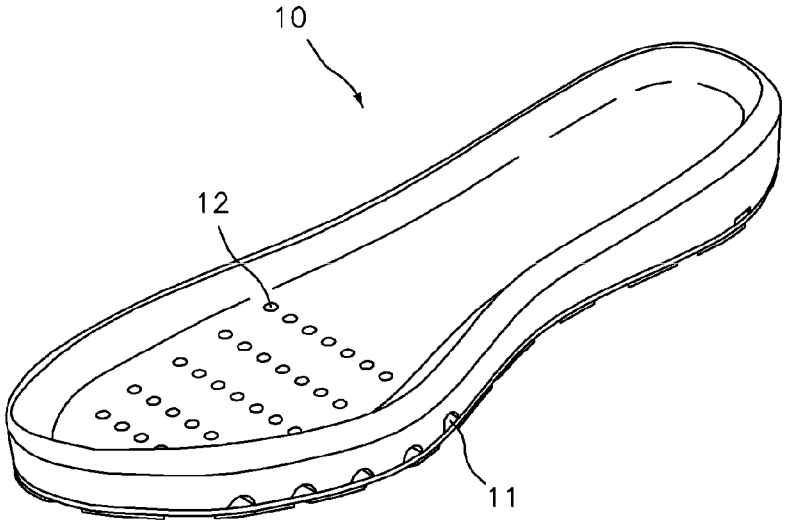
FIG. 1 is a perspective view of a ventilation sole for footwear of the related art.

90: device for opening and closing an air inlet-outlet
100: main cap
200: button cap
210: ambient air inlet-outlet hole
220: pressure section
230: grasping recess
300: elastic stopper
310: protruding section
320: sealing member
330: support plate
340: flow passage-forming plate
350,360: air inlet-outlet passage
370: spring
400: elastic stopper holder
500: spring cover
510: inner air inlet-outlet hole

DETAILED DESCRIPTION OF THE INVENTION

In order to realize the foregoing object, the present invention relates to a ventilation sole for footwear, in which an air inlet-outlet is formed in a side of the ventilation sole, vents are formed in an upper portion of the ventilation sole, the vents communicating with the air inlet-outlet, and a device for opening and closing an air inlet-outlet, which is coupled with the air inlet-outlet, supplies ambient air into the footwear. The device for opening and closing an air inlet-outlet is adapted to be opened or closed by a locking or unlocking action when turned, and is disposed in the air inlet-outlet such that it is exposed to the outside.

Here, the device for opening and closing an air inlet-outlet generally includes a main cap, a button cap inserted into the main cap, and an elastic stopper inserted into the main cap. The front and rear portions of the main cap have an open structure to form a flow passage. The button cap is coupled such that it is exposed through the air inlet-outlet, and can be locked or unlocked. The elastic stopper elastically advances and retreats in response to a locking or unlocking action of the button cap, thereby opening or closing the flow passage formed in the main cap. The device also includes an elastic stopper holder, which is sealably coupled with the elastic stopper, and a spring cover, which supports a spring of the elastic stopper.

Figure 2:
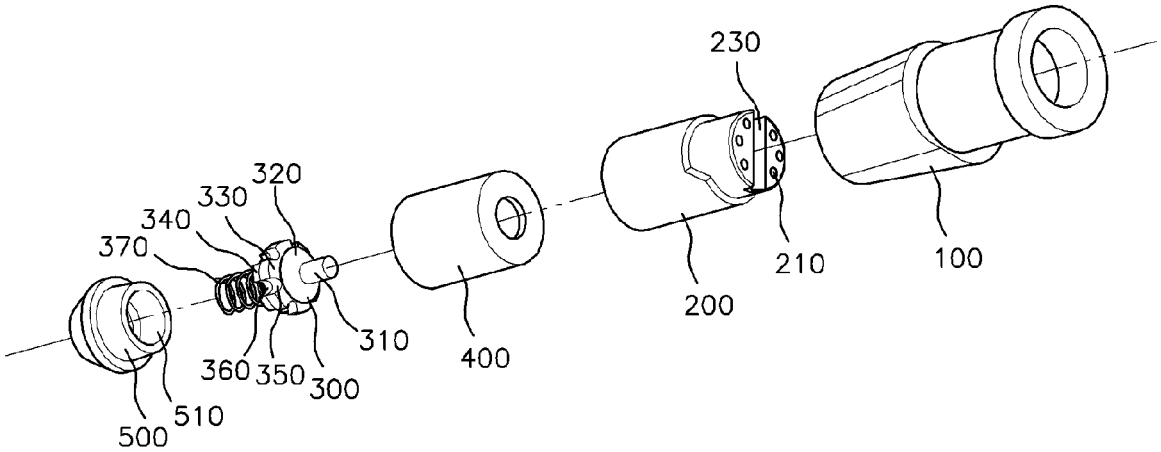
FIG. 2 is an exploded perspective view of a device for opening and closing an air inlet-outlet, which is applicable to the present invention.
Figure 3:
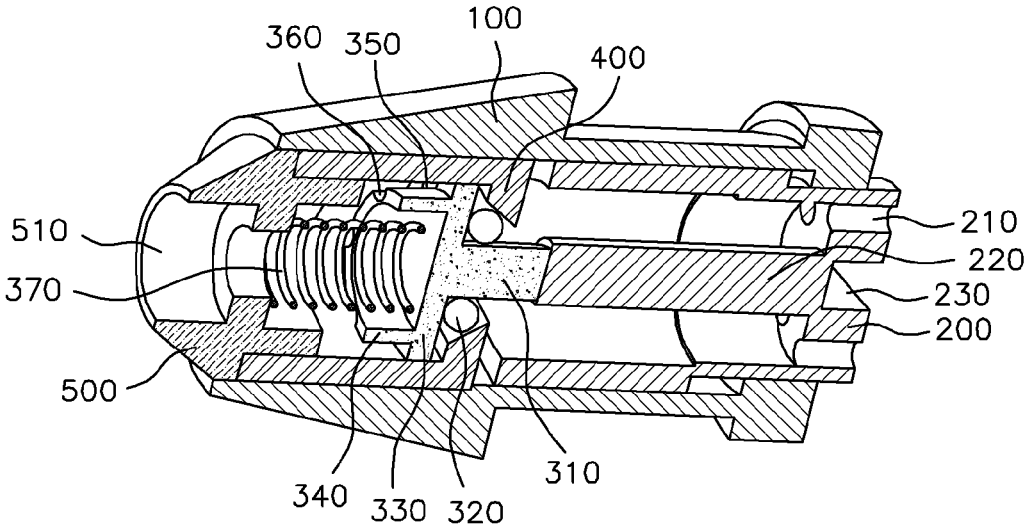
FIGS. 3*a* and 3*b* are cross-sectional views depicting the operation of the device for opening and closing an air inlet-outlet, which is applicable to the present invention (arrows indicate a flow passage).
Figure 3:
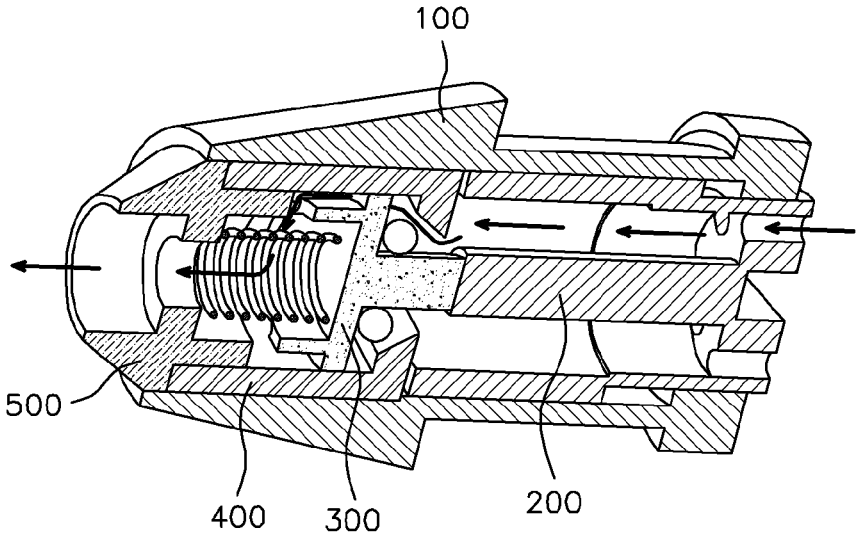
Figure 4:
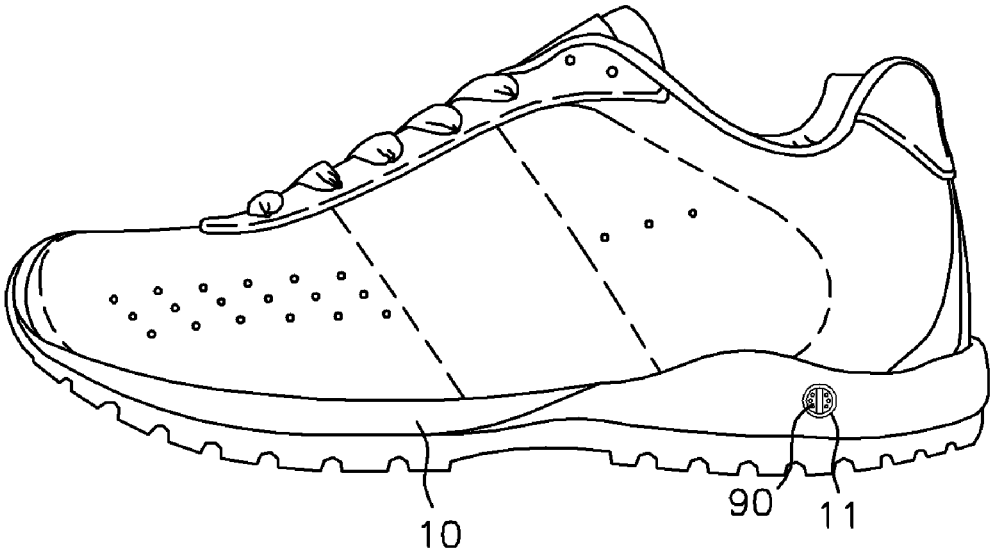
FIG. 4 is a side-elevation view of a piece of footwear to which a ventilation sole for footwear of the present invention is applied.

Hereinafter exemplary embodiments of the present invention will be described in detail with reference to the accompanying drawings. FIG. 2 is an exploded perspective view of a device for opening and closing an air inlet-outlet, which is applicable to the present invention, FIGS. 3*a* and 3*b* are cross-sectional views depicting the operation of the device for opening and closing an air inlet-outlet, which is applicable to the present invention (arrows indicate a flow passage), and FIG. 4 is a side-elevation view of a piece of footwear to which a ventilation sole for footwear of the present invention is applied.

As shown in the figures, the device 90 for opening and closing an air inlet-outlet, which is applicable to the present invention, generally includes a cylindrical main cap 100, which is closely coupled with the air inlet-outlet in the state in which both ends thereof are open; a button cap 200, which is inserted into the main cap 100; an elastic stopper 300, which advances and retreats in response to a turning action, i.e. locking and unlocking, of the button cap 200; an elastic stopper holder 400, which is closely coupled with the elastic stopper 300; and a spring cover 500, which supports a spring 370 of the elastic stopper 300.

First, the main cap 100 is cylindrically shaped, is opened from the front end to the rear end, thereby forming a flow passage, and has defined therein a space, in which the button cap 200, the elastic stopper 300, the elastic stopper holder 400 and the spring cover 500 are contained.

Threads are formed in a predetermined portion of the inner portion of the main cap 100, i.e. the inner circumference adjacent to the outer portion of the air inlet-outlet, such that the button cap 200, which will be described later, is locked and unlocked. The threads formed in the inner circumference of the main cap 100 extend a half pitch or one pitch, so that locking and unlocking are rapid. The button cap 200 also has corresponding threads. Accordingly, when the button cap 200 is turned, the button cap 200 is locked or unlocked, so that the button caps 200 advances or retreats inside the main cap 100.

In addition, in the main cap 100, a protruding portion, which becomes narrower as it extends inwards, is formed in the outer circumference of the portion that is coupled with the inner portion of the air inlet-outlet. A portion exposed to the air inlet-outlet is formed such that the diameter thereof is relatively greater than that of other portions. When this portion is coupled to the air inlet-outlet, this portion can be securely coupled to the inner circumference of the air inlet-outlet.

Next, the button cap 200 is inserted into the main cap 100, such that one end thereof is screwed with the main cap 100. The button cap 200 is formed as a cylinder, with both ends thereof being open. One end is partially open, thereby forming ambient air inlet-outlet holes 210, and the other end is completely open.

One end of the button cap 200, i.e. the head, is coupled with the main cap 100, such that it is exposed toward the air inlet-outlet. When the exposed head is grasped and turned, the button cap 200 is locked to or unlocked form the main cap 100, so that it advances or retreats inside the main cap 100.

In the central portion of the button cap 200, a pressure section 220 is formed such that it is in contact with a protruding section 310 of the elastic stopper 300, which will be described later. The pressure section 220 is spaced apart from the outer circumference of the button cap 200, thereby forming a kind of flow passage that is connected with the ambient air inlet-outlet holes 210. When the button cap 200 advances following the locking of the button cap 200, the pressure section 220 presses the elastic section 310, so that the elastic stopper 300 advances. As a result, the entire device 90 for opening and closing an air inlet-outlet is opened. Of course, when the button cap 200 retreats in response to the unlocking of the button cap 200, the elastic stopper 300 correspondingly retreats. The pressure section 220 and the protruding section 310 are elastically forcing each other owing to the spring 370 of the elastic stopper 300, which will be described later. This, as a result, accomplishes a complete seal.

In addition, in the portion of the button cap 200 exposed to the air inlet-outlet, a grasping recess 230 is formed in the head of the button cap 200, such that the button cap 200 can be easily rotated. This makes it possible to grasp the grasping recess 230 with a finger or nail or inserting a finger into the grasping recess 230, so that the button cap 200 can be easily rotated. The grasping recess 230 is formed to be linear or cross.

Furthermore, a plurality of ambient air inlet-outlet holes 210 is formed on both sides of the grasping recess 230, such that air can be efficiently introduced and discharged.

Next, the elastic stopper 300 is formed such that it is inserted into the main cap 100, so that it advances and retreats following the advancement and retreat of the button cap 200. The elastic stopper 300 is formed such that it is in contact with the pressure section 220 of the button cap 200, so that it can advance and retreat. In the outer circumference, air inlet-outlet passages 350 and 360 are formed in the outer circumference of the protruding section 310. One end of the spring 370 is supported on the other side of the protruding section 310, such that it enables elastic advancement or retreat in response to the locking or unlocking of the button cap 200.

In addition, in the elastic stopper 300, a sealing member 320 is coupled to the outer circumference of the elastic section 310. With the sealing member 320, a seal is provided between the elastic stopper 300 and the elastic stopper holder, which will be described later. When the elastic stopper 300 is forced to retreat by the unlocking action, i.e. the retreating action, of the button cap 200, it is sealed on the inner circumference of the elastic stopper holder 400 via the sealing member 320, thereby closing the device 90 for opening and closing an air inlet-outlet. When the elastic stopper 300 is forced to advance by the locking action, i.e. the advancing action, of the button cap 200, a flow passage is formed between the elastic stopper 300 and the elastic stopper holder 400, thereby opening the device 90 for opening and closing an air inlet-outlet.

In addition, the elastic stopper 300 has a support plate 330 continuing from the other side of the elastic section 310. The diameter of the support plate 330 is relatively greater than that of the elastic section 310, such that the air inlet-outlet passage 350 is formed in the outer circumference of the support plate 330, and is in contact with the inner circumference of the elastic stopper holder 400. The support plate 330 forms a flow passage by the air inlet-outlet passage 350, which is formed in the outer circumference of the support plate 330 and is in contact with the inner circumference of the elastic stopper holder 400, such that air can be introduced and discharged.

In addition, the elastic stopper 300 also has a flow passage-forming plate 340, which continues from the other side of the support plate 330. The diameter of the flow passage-forming plate 340 is relatively smaller than that of the support plate 330. The flow passage-forming plate 340 has defined the air inlet-outlet passage 360 in the outer circumference thereof and a receiving portion in the central portion thereof, such that the spring 370 is contained in the receiving portion. The air inlet-outlet passage 360 of the flow passage-forming plate 340 is continuously formed, corresponding to the air inlet-outlet passage 350 formed in the support plate 330. The spring 370 is contained in the receiving portion, such that one end thereof is supported on the receiving portion. The other end of the spring 370 is supported by the spring cover 500, which will be described later.

Next, the elastic stopper holder 400 contains the elastic stopper 300 inside the main cap 100, such that the elastic stopper holder 400 and the elastic stopper 300 form a seal via the sealing member 320. Here, when the button cap 200 is locked, the elastic stopper 300 is caused to advance to form a flow passage between the sealing member 320 and the elastic stopper holder 400. When the button cap 200 is unlocked, the elastic stopper 300 is caused to retreat, so that the sealing member 320 forms a seal between the elastic stopper 300 and the elastic stopper holder 400.

In addition, the elastic stopper holder 400 is closely coupled with the inner circumference of the main cap 100. The formation of the flow passage by the advancement of the elastic stopper 300 in response to the locking of the button cap 200 is defined only by the space between the elastic stopper 300 and the elastic stopper holder 400 via the ambient air inlet-outlet holes 210 of the button cap 200 and by an inner air inlet-outlet hole 510 of the spring cover 500, which will be described later, via the air inlet-outlet passages 350 and 360 of the elastic stopper 300.

In addition, the elastic stopper holder 400 has a cylindrical shape in order to enhance the sealing ability with the elastic stopper 300 via the sealing member 320. The diameter of the portion of the elastic stopper holder 400 adjacent to the elastic section 310 is smaller than that of the other portions, such that it is sealably coupled with the sealing member 320, which is coupled with the elastic section 310. That is, it is desirable that this portion conform to the size of the sealing member 320.

Next, the spring cover 500 is inserted into the main cap 100 such that it is located in the innermost portion of the air inlet-outlet, which is formed in the footwear sole. The spring cover 500 supports the other end of the spring 370 of the elastic stopper 300. The spring cover 500 is closely coupled with the elastic stopper holder 400 in order to prevent unnecessary flow passages from forming. The inner air inlet-outlet hole 510, which is intended to form a flow passage, is formed in the central portion of the spring cover 500. Accordingly, the air introduced from the outside is finally supplied to the inside of the footwear through the inner air inlet-outlet hole 510.

The device 90 for opening and closing an air inlet-outlet, which is configured as above such that it is coupled with the air inlet-outlet of the footwear sole, is exposed to the outside of an air inlet-outlet 11 in the side of the footwear sole 10, as shown in FIG. 4. As shown in the figure, grasping and turning the head of the button cap 200, which is exposed to the outside of the air inlet-outlet 11, causes the button cap 200 to advance inside the main cap 100, with which the button cap 200 is screw engaged. The advancement causes the pressure section 220 of the button cap 200 to press the elastic section 310 of the elastic stopper 300, so that the elastic stopper 300 also advances. Here, the elastic stopper 300 is brought into contact with and is elastically pressed against the pressure section 220 by the spring 370.

When the elastic stopper 300 advances, the seal between the elastic stopper 300 and the elastic stopper holder 400 is disabled, thereby forming a flow passage, so that the device 90 for opening and closing an air inlet-outlet is opened by one flow passage.

That is, the air that has been introduced through the ambient air inlet-outlet holes 210 of the button cap 200 passes through the flow passage, which is formed when the elastic stopper 300 and the elastic stopper holder 400 are separated from each other by the advancement of the button cap 200, through the air inlet-outlet passages 350 and 360 of the elastic stopper 300, and then through the inner air inlet-outlet hole 510 of the spring cover 500. The fresh air is then supplied into the footwear through vents in the footwear sole.

The user can simply perform the locking or unlocking action by turning the button cap 200 as required, so that the device 90 for opening and closing an air inlet-outlet is opened to the inside and outside the footwear, or the device 90 for opening and closing an air inlet-outlet is closed if the introduction or discharge of the air is not necessary.

What is claimed is:

1. A ventilation sole for footwear, comprising:

an air inlet-outlet formed at a side of the ventilation sole;

vents formed at an upper portion of the ventilation sole, the vents communicating with the air inlet-outlet;

a device for opening and closing the air inlet-outlet, the device being coupled with the air inlet-outlet for supplying ambient air into the footwear, wherein the device for opening and closing the air inlet-outlet comprises:

a main cap having an axial through opening formed there-through;

a button cap inserted in the axial through opening of the main cap, the button cap defining an axial air flow passage there-through and having a distal end portion exposed through the air inlet-outlet, the distal end portion adapted to be rotated by a user to axially move the button cap between a locked position and an unlocked position while rotating about a center axis of the button cap;

an elastic stopper inserted in the axial through opening of the main cap, wherein the elastic stopper having a distal end portion abutting a proximal end portion of the button cap, and having air inlet-outlet passages formed therein to communicate with the axial air flow passage of the button cap, wherein the elastic stopper is supported by a spring and axially moveable to elastically advance and retreat in response to the axial movement of the button cap between said locked position and said unlocked position; and an elastic stopper holder disposed inside the axial through opening of the main cap, wherein the elastic stopper holder has an axial inner opening, and the elastic stopper is slidably received in the axial inner opening, and wherein the elastic stopper holder is sealably coupled with the elastic stopper via a sealing member to close air flow between the axial air flow passage of the button cap and the air inlet-outlet passages of the elastic stopper when the elastic stopper is retreated as the button cap is in the unlocked position, and a seal between the elastic stopper and the elastic stopper holder is released to open the air flow between the axial air flow passage of the button cap and the air inlet-outlet passages of the elastic stopper when the elastic stopper is advanced as the button cap is in the locked position.

2. The ventilation sole of claim 1, wherein a pressure section is formed in a central portion of the button cap, and ambient air inlet-outlet holes are formed around the pressure section;

wherein the elastic stopper has a protruding section abutting against the pressure section of the button cap, and one end of the spring being supported on a proximal end portion of the elastic stopper; and the ventilation sole further comprising a spring cover inserted into the main cap, wherein the spring cover is coupled with the elastic stopper holder, supports the other end of the spring of the elastic stopper, and has an inner air inlet-outlet in a central portion of the spring cover.

3. The ventilation sole of claim 1, wherein the button cap has a grasping recess in the distal end portion of the button cap in a portion thereof that is exposed to the air inlet-outlet, the grasping recess facilitating a rotation of the button cap.

4. The ventilation sole of claim 3, wherein the button cap has a plurality of the ambient air inlet-outlet holes on both sides of the grasping recess.

5. The ventilation sole of claim 2, wherein the elastic stopper comprises:

the protruding section in contact with the pressure section of the button cap;

the sealing member coupled with an outer circumference of the protruding section;

a support plate formed on a proximal side of the protruding section, wherein a diameter of the support plate is greater than that of the protruding section, some of the air inlet-outlet passages are formed in a circumference of the support plate, and the support plate is in contact with an inner circumference of the elastic stopper holder; and a flow passage-forming plate formed on a proximal side of the support plate, wherein a diameter of the flow passage-forming plate is smaller than that of the support plate, wherein the flow passage-forming plate has an some of the air inlet-outlet passages formed in a circumference thereof and a receiving portion, which contains the spring therein, formed in a central portion thereof.

6. The ventilation sole of claim 5, wherein the elastic stopper holder is cylindrically shaped, wherein a diameter of a portion of the stopper holder that is adjacent to the protruding section is smaller than that of the other portions of the stopper holder, such that of the stopper holder is closely coupled with the sealing member, which is coupled with the protruding section.

* * * * *